US005858054A

United States Patent [19]

Rosen

[11] Patent Number: 5,858,054

[45] Date of Patent: Jan. 12, 1999

[54] KNITTED PROTECTIVE FABRIC AND GARMENTS MADE THEREFROM

[76] Inventor: Arthur Rosen, 7 Cote Ste. Catherine, #907, Montreal, Quebec, Canada, H2V 1Z9

[21] Appl. No.: 792,647

[22] Filed: Jan. 31, 1997

[51] Int. Cl.[6] ..... D04B 1/10

[52] U.S. Cl. ..... 66/202; 2/2.5; 2/69; 66/169 R; 66/171; 66/195; 428/911; 442/304

[58] Field of Search ..... 428/911; 2/2.5, 2/69; 442/304; 66/169 R, 171, 202, 195

[56] References Cited

U.S. PATENT DOCUMENTS

| | | | |
|---|---|---|---|
| 254,274 | 5/1882 | Avins . | |
| 254,275 | 5/1882 | Avins . | |
| 342,163 | 12/1886 | Lessner . | |
| 3,144,534 | 8/1964 | Baumbach . | |
| 3,447,345 | 6/1969 | Kurz | 66/195 |
| 4,229,954 | 10/1980 | Blore | 66/196 |
| 4,279,956 | 7/1981 | Bartels | 428/192 |
| 4,416,934 | 11/1983 | Kimura et al. | 428/224 |
| 4,493,865 | 1/1985 | Kuhlmann et al. | 428/52 |
| 4,513,042 | 4/1985 | Lumb | 428/95 |
| 4,548,057 | 10/1985 | Essig | 66/172 |
| 4,649,722 | 3/1987 | Gajjar | 66/195 |
| 4,772,510 | 9/1988 | McClure | 428/286 |
| 4,818,585 | 4/1989 | Shipp, Jr. | 428/198 |
| 4,841,577 | 6/1989 | Lars-Jos | 2/161 |
| 4,890,462 | 1/1990 | Essig | 66/196 |
| 4,897,296 | 1/1990 | Marshall, Jr. | 428/102 |
| 4,910,805 | 3/1990 | Kakinoki et al. | 2/243 A |
| 4,970,109 | 11/1990 | Bryant et al. | 428/254 |
| 5,027,618 | 7/1991 | Robinson et al. | 66/202 |
| 5,319,950 | 6/1994 | Whitt et al. | 66/182 |
| 5,321,960 | 6/1994 | Whitt et al. | 66/182 |

*Primary Examiner*—James J. Bell
*Attorney, Agent, or Firm*—Robert A. Wilkes

[57] ABSTRACT

A protective fabric, and garments made therefrom, having superior resistance to wear and abrasion, as well as good flexibility and stretchability enabling the fabric to be conformed to the structure intended to be protected. The knitted fabric and garments made therefrom comprise a monofilament polymer having a gauge of 0.03 to 0.08 inches interknitted to form a structure of repeated interconnected loops or coils. The structure may be honeycomb-like in appearance. The monofilament polymer may be from a material selected from the group consisting of polyamide, Teflon, polyester or viscose.

10 Claims, 4 Drawing Sheets

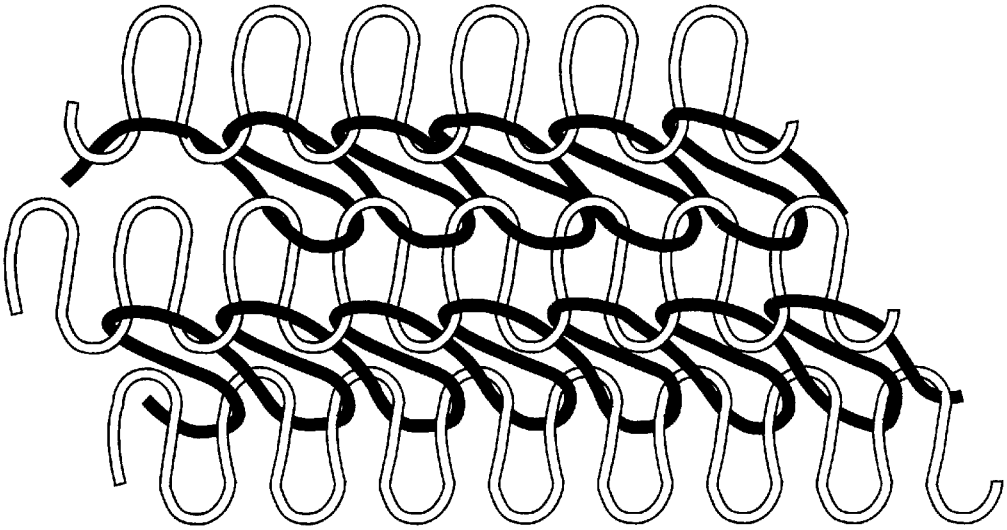
FIG. 2A
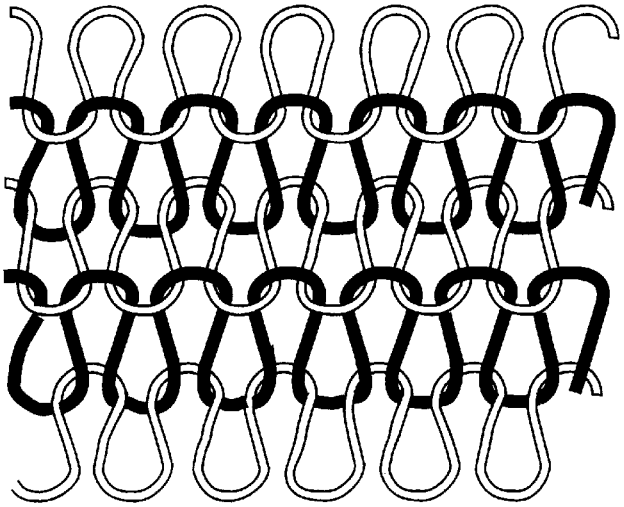
FIG. 2B
FIG. 2C
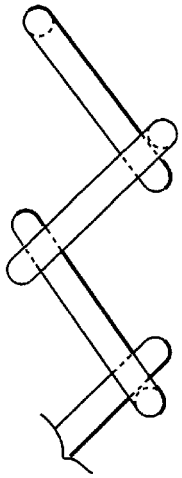

KNITTED PROTECTIVE FABRIC AND GARMENTS MADE THEREFROM

BACKGROUND OF THE INVENTION

The invention relates to knitted protective fabrics and garments made therefrom.

The prior art is replete with protective fabrics used in a variety of contexts including protective clothing for use by athletes, law enforcement and military personnel; and material for use in manufacturing, packaging and outdoor applications. Ideally, protective fabrics will be light and will exhibit sufficient flexibility to conform to the surface intended to be protected, without compromising the strength and resilience properties required to achieve the desired protective effect. For example, in the case of fabrics used to make protective clothing, the garment must be flexible enough to conform to the wearer's body, yet have adequate rigidity to impart the necessary strength characteristics, i.e. to avoid injury arising from high impact falls or violent impact by objects whether large and blunt or small and piercing, without unduly compromising freedom of movement or comfort.

One approach is found in ballistic resistant articles which use reinforced fibres to create a woven fabric, as shown by U.S. Pat. No. 4,737,401. However, these and other conventional woven fabrics are made with light gauge yarn filaments which yields a fine weave. Such fabrics are relatively light but exhibit poor resistance to wear and abrasion. Further, although woven fabrics are flexible and can conform to the surface intended to be protected, such fabrics lack elastic properties (stretchability) and are ill-suited for cushioning against force from blunt objects, sharp edges and shock impact which may result from a fall while in motion, a common occurrence in sports such as in-line skating, bicycling, skate boarding, etc.

Another approach is to add padding or other layers of material to reinforce the fabric for desired purposes, but this approach increases cost and complexity in the design and manufacturing process. Moreover, the padding can be bulky, and unseemly in appearance.

A still further type of protective fabric is metal ring (chain mail) fabric. Chain mail fabric is used to make protective garments for persons who are at risk of injury as a result of their having to work with knives, sharp tools or machinery which is used to cut, perforate, or puncture other objects. Chain mail fabric is strong and flexible enough to hug the body of the wearer, forming a protective sheath around the selected body part, thereby avoiding possible entanglement with loosely hanging garments, and protecting the wearer from injury from sharp objects. However, chain mail is not adapted to cushion against shock or abrasion because it is not stretchable.

Moreover, chain mail garments are relatively expensive to manufacture and have a number of other disadvantages. For example, the repeating series of metal rings which are used in chain mail result in a protective garment which is heavier than conventional garments made from yarn or non-metal fabric, and which may be uncomfortable worn next to the skin for prolonged periods in hot, humid or very cold conditions. Further, the metal can chafe or irritate the skin of the wearer, particularly if motions are repeated. A further drawback of chain mail is its relative lack of elasticity. The prior art reflects a number of attempts to address this problem. U.S. Pat. No. 4,802,242 describes a chain mail garment which orients the metal rings with regard to the natural motion of the body so as to avoid tension in connection with bending movements. Similarly, U.S. Pat. No. 5,511,241 describes a chain mail fabric of a protective garment which is impregnated with an elastomeric material to impart elastic characteristics to the fabric.

SUMMARY OF THE INVENTION

It has been found that use of heavy gauge polymer monofilament having a gauge of between 0.03" to 0.08" can be used to produce a knit fabric which has superior resistance to wear, puncture and abrasion, while possessing good flexibility and stretchability which enables the fabric to be conformed to the structure intended to be protected.

Accordingly, the present invention seeks to overcome the disadvantages of protective fabrics which are known in the art by providing a protective knitted fabric which comprises a monofilament polymer having a gauge of 0.03 to 0.08 inches interknitted to form a structure of repeated interconnected loops or coils. The structure may be honeycomb-like in appearance. The monofilament polymer may be from a material selected from the group consisting of polyamide, Teflon, polyester or viscose.

The knitting technique used can be single, double, warp, interlock or pique. Polyamide (nylon) monofilaments are preferred. Preferably, the gauge of the monofilament will be approximately 0.065 inches.

Unlike light gauge filaments or spun yarn used in making conventional knitted fabrics, a monofilament polymer having a gauge of 0.03 to 0.08 inches, when knit, possesses sufficient firmness, hardness and tensile strength to provide a protective effect against shock, puncture, and abrasions. The foregoing properties of such a monofilament create a coiling effect when strands of the monofilament are intertwined in a knit structure. When knitted, the stiffness of the monofilament creates a layer which is approximately ⅜" thick and acts as a spring-like cushion against hard surfaces and edges. The spring-like cushion so created is able to compress by approximately 75% of its thickness, which acts to reduce the impact from shock resulting from a blow or other force.

As will be understood by those skilled in the art, the structure of a knit fabric results in increased structural flexibility and stretchability which is not present in a woven fabric. Accordingly, the monofilament used in the present invention, and the coil-like structure that results when such a monofilament is intertwined to define a knit structure, has sufficient flexibility to enable it to be conformed to the structure intended to be protected. Moreover, the texture of the monofilaments is softer than chain mail, and reduces the likelihood of abrasion to the surface being protected. This is particularly important in the context of protective garments since chain mail can chafe or irritate when worn next to the skin for prolonged periods. The monofilament used in the present invention is lightweight, and the porous structure of the knit structure allows the fabric to breathe to an extent not possible with woven fabrics made with reinforced fibres, or which are reinforced with layers of padding or other material. Again, this is desirable in the context of protective garments. Protective garments made in accordance with the invention are therefore more comfortable to wear because they are lighter, and the coil-like structure has a radiator-like effect which is cooling, particularly where the wearer is in motion.

In a further embodiment, the invention provides a protective garment comprising a monofilament polymer having a gauge of 0.03 to 0.08 inches which has been interknitted to form a structure of repeated interconnected loops or coils.

DESCRIPTION OF THE DRAWINGS

Embodiments of the invention will now be illustrated with reference to the accompanying figures, wherein:

FIG. 2A is a representation of one embodiment of the protective knitted fabric of the invention, in perspective view, showing the fabric stretched by approximately 60%;

FIG. 2B is a representation of one embodiment of the protective knitted fabric of the invention, in front view, showing the fabric stretched by approximately 60%;

FIG. 2C is a representation in side view of one embodiment of the protective knitted fabric of the invention, wherein the fabric has been stretched by approximately 60%;

The embodiment of the protective knitted fabric depicted in FIG. 1 was produced with 0.065" nylon gauge monofilament using a single knit method (by hand) with a number 7 needle for the gauge (0.065") of nylon monofilament. FIGS. 2A–2C show a single knit fabric produced from such a nylon filament. The fabric is highlighted by the integrally linked monofilament loops, which produce a honeycomb-like structure.

FIGS. 2A, 2B and 2C illustrate how the strands of intertwined monofilament interact to create a coil-like structure with elastic properties. The orientation of the opposing stitches creates leverage effect which maintain the rows of stitches at approximately 30 degrees to one another, contributing to the elasticity of the knitted fabric and its ability to withstand shock from impact.

FIG. 3 illustrates the coil effect produced by the intertwining of the thick, stiff monofilament which occurs during the knitting process. The properties of the monofilament results in a tendency for a layer of knitted fabric made therefrom to coil, as shown in FIG. 3, since a single strand of monofilament is twisted in one direction all the way through the knitting process. This coiling structure contributes to the resilience of the fabric and its shock absorbency.

In FIG. 4, a representative protective garment knitted from heavy gauge nylon monofilaments is depicted. FIG. 4 shows a hand guard, but it will be understood that other types of garments such as jackets, vests, knee pads, elbow pads, shin guards, headgear, trousers, etc. intended to be worn on other parts of the body can be similarly made and are within the scope of the invention.

Figure 1:
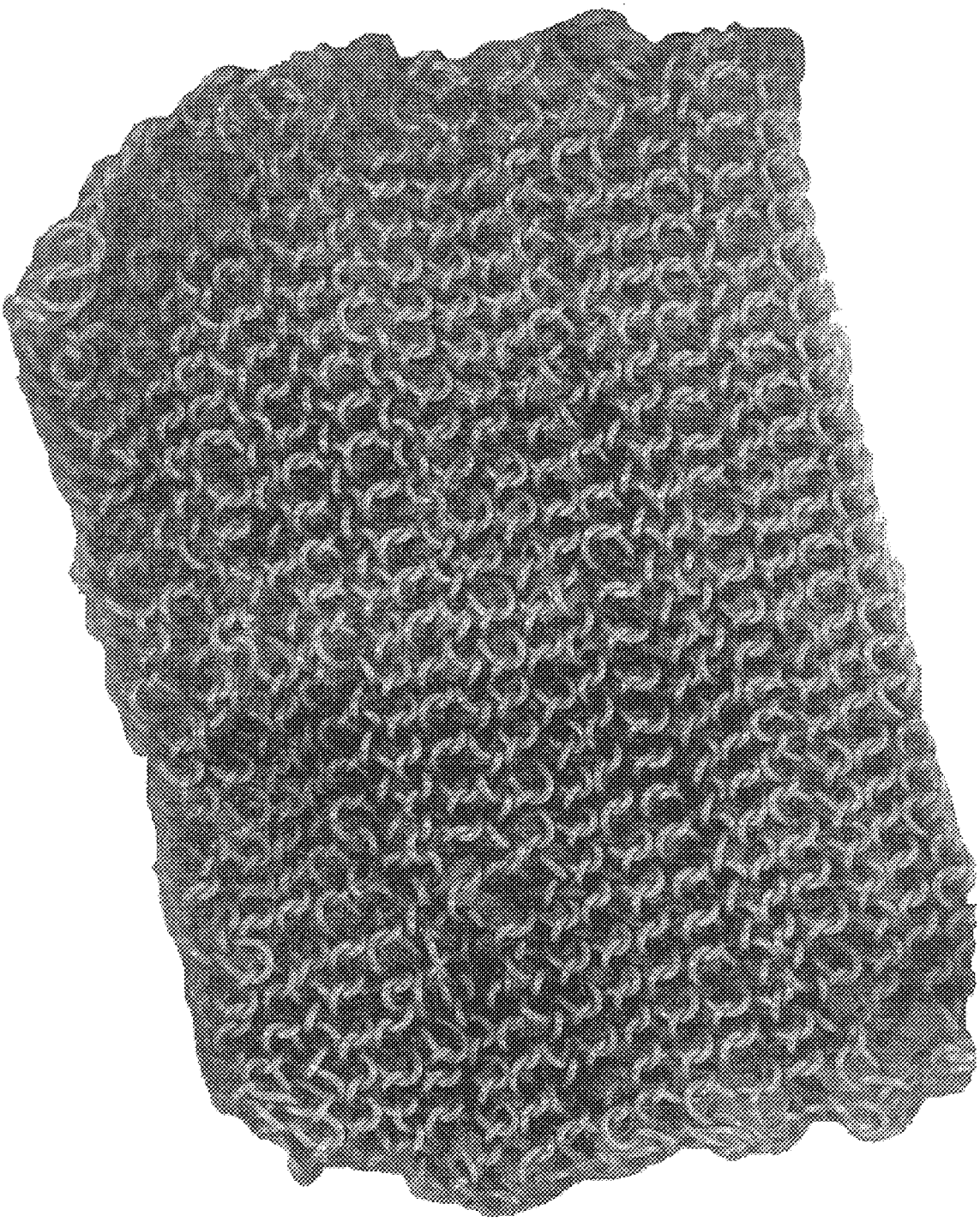
FIG. 1 is a photograph depicting one embodiment of the protective knitted fabric of the invention arranged flat.
Figure 3:
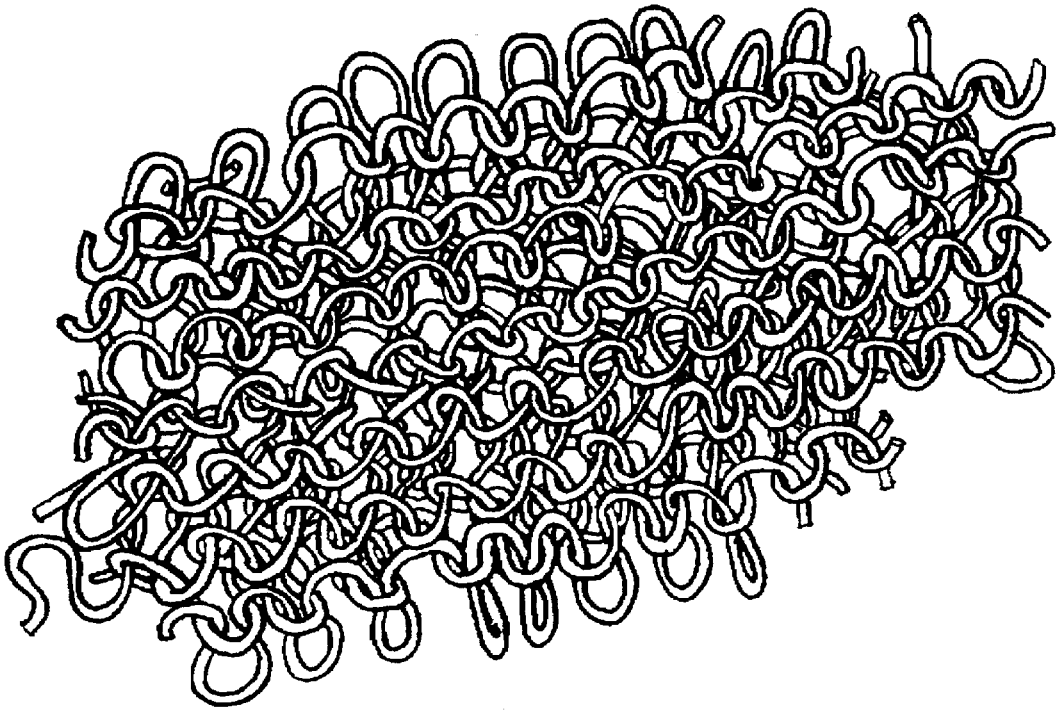
FIG. 3 is a representation of one embodiment of the protective knitted fabric according to the invention depicting the coiling effect of at least one layer of fabric.
Figure 4:
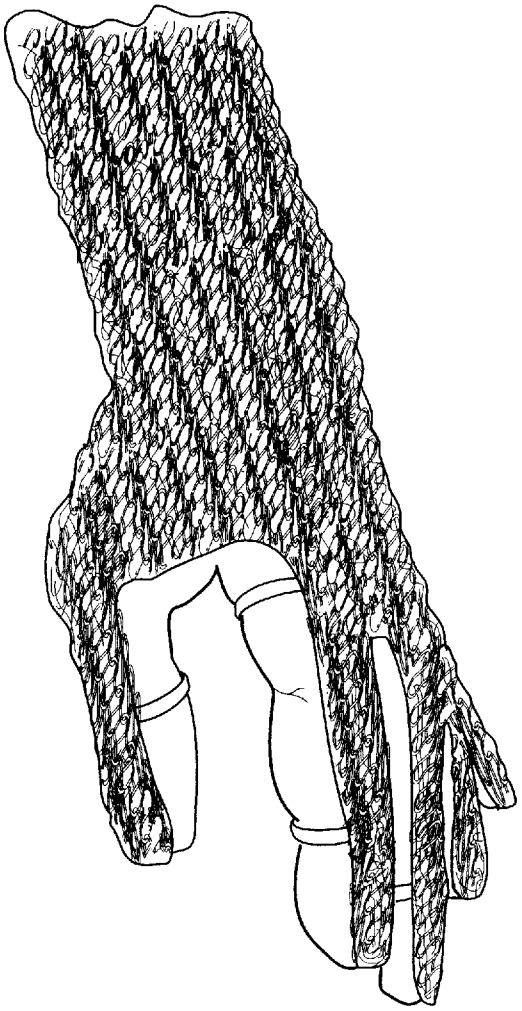
FIG. 4 is a representation of a protective knitted garment made in accordance with the present invention.

Protective knitted fabrics according to the invention, and garments made therefrom, are lightweight, have excellent tensile strength, porosity, elasticity and flexibility. As a result of these properties, the said fabrics and garments provide an improved physical protective barrier against shock, abrasion, and puncture. Accordingly, the knitted fabric of the invention has a wide range of applications and use, including but not limited to : packaging for fragile items; construction or fencing material; mooring material; protective material for livestock or plants; and foundation support for structures which must have some resilience, such as flooring or furniture.

Protective garments made in accordance with the invention can be used to protect portions of the body in contact sports or other activities where there is a risk of injury from abrasion, shock impact, or puncture such as motorcycling, bicycling, inline skating, skate boarding, skate boarding, hockey and football, skiing, riding, scuba diving, hang-gliding, martial arts, animal training or handling, rodeo and bull fighting. Such protective garments would also find application for law enforcement and military activities.

The embodiments of the invention in which an exclusive property or privilege is claimed are defined as follows:

1. A protective knitted fabric comprising strands of a monofilament polymer of 0.03 to 0.08 inch gauge wherein said monofilament strands are interknitted to form a repeating structure of interconnected loops.

2. The knitted fabric of claim 1 wherein the technique for knitting said monofilament strands is selected from the group comprising single, double, warp, interlock or pique.

3. The knitted fabric of claim 1 or 2 wherein the monofilament polymer is selected from the group comprising polyamide fibres (nylon), Teflon, polyester, or viscose.

4. The knitted fabric of claim 1 or 2 wherein said monofilament polymer is heavy gauge nylon having a gauge of 0.065 inch.

5. The knitted fabric of claim 1 or 2 wherein said monofilament polymer is heavy gauge nylon having a gauge of 0.065 inch, and the strands are knit using a single knit method.

6. A protective knitted garment comprising strands of a monofilament polymer of 0.03 to 0.08 inch gauge wherein said monofilament strands are interknitted to form a repeating structure of interconnected loops.

7. The protective knitted garment of claim 6 wherein the technique for knitting said monofilament strands is selected from the group comprising single, double, warp, interlock or pique.

8. The protective knitted garment of claim 6 or 7 wherein the monofilament polymer is selected from the group comprising polyamide fibres (nylon), Teflon, polyester, or viscose.

9. The protective knitted garment of claim 6 or 7 wherein said monofilament polymer is heavy gauge nylon having a gauge of 0.065 inch.

10. The protective knitted garment of claim 6 or 7 wherein said monofilament polymer is heavy gauge nylon having a gauge of 0.065 inch, and the strands are knit using a single knit method.

* * * * *

UNITED STATES PATENT AND TRADEMARK OFFICE

CERTIFICATE OF CORRECTION

PATENT NO. : 5,858,054

DATED : 1/12/1999

INVENTOR(S) : ROSEN, Arthur

It is certified that error appears in the above-identified patent and that said Letters Patent is hereby corrected as shown below:

Delete Fig. 2 on sheet 2 and substitute Fig. 2 as shown on the attached page.

Signed and Sealed this

Twentieth Day of July, 1999

*Attest:*

*Attesting Officer*

Q. TODD DICKINSON

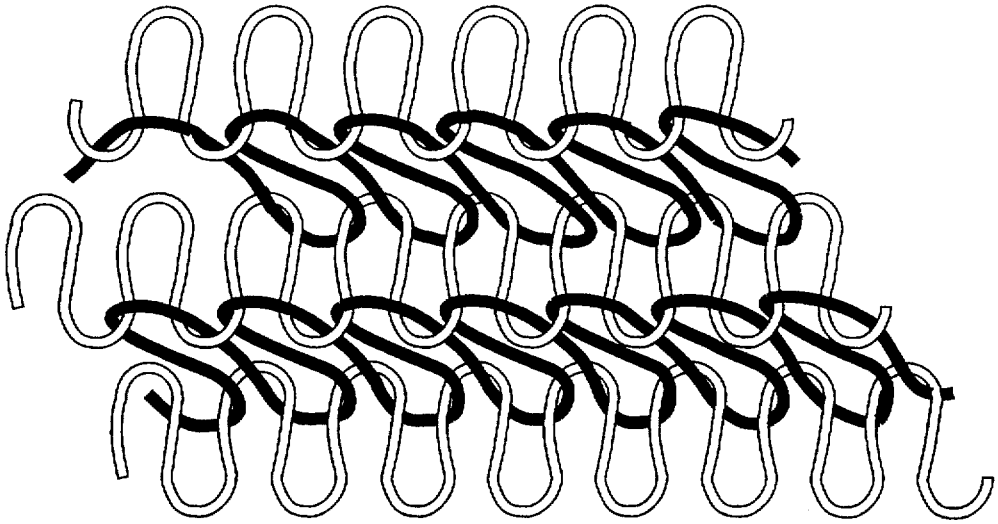
FIG. 2A
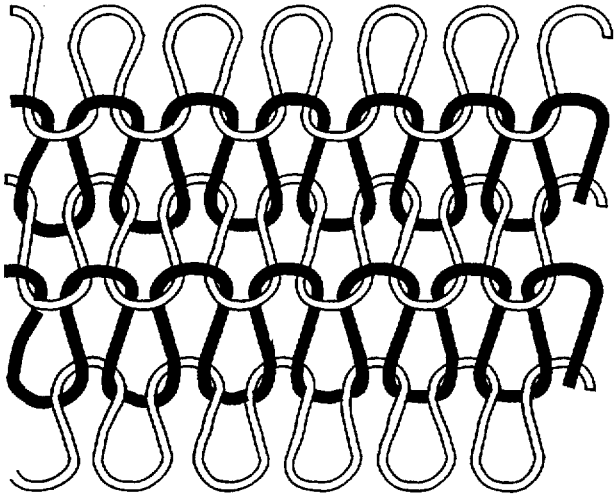
FIG. 2B
FIG. 2C
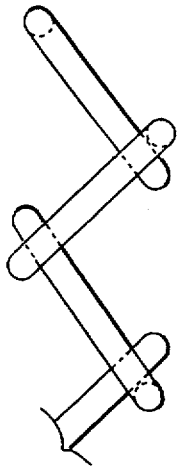

*Acting Commissioner of Patents and Trademarks*